US010292568B1

(12) United States Patent
Ricks

(10) Patent No.: US 10,292,568 B1
(45) Date of Patent: May 21, 2019

(54) DEVICE FOR CLEANING THE SOLES OF SHOES

(71) Applicant: Kynan Alon Ricks, San Diego, CA (US)

(72) Inventor: Kynan Alon Ricks, San Diego, CA (US)

( * ) Notice: Subject to any disclaimer, the term of this patent is extended or adjusted under 35 U.S.C. 154(b) by 32 days.

(21) Appl. No.: 15/863,627

(22) Filed: Jan. 5, 2018

(51) Int. Cl.
*A47L 23/00* (2006.01)
*A47L 23/18* (2006.01)
*A47L 23/26* (2006.01)

(52) U.S. Cl.
CPC ..... *A47L 23/266* (2013.01); *A47L 23/18* (2013.01); *A47L 23/00* (2013.01)

(58) Field of Classification Search
CPC ..... A47L 23/22; A47L 23/18
See application file for complete search history.

(56) References Cited

U.S. PATENT DOCUMENTS 2,436,234 A * 2/1948 Stein ..... A47L 23/22 15/112
4,425,677 A * 1/1984 Cox ..... A47L 23/26 15/104.92
4,866,805 A * 9/1989 Oden ..... A47L 23/266 15/104.92
5,345,641 A * 9/1994 Webster ..... A47L 23/26 15/105
D406,931 S * 3/1999 Morris ..... D32/47
5,996,160 A * 12/1999 Pruitt ..... A47L 23/24 15/104.92
6,253,407 B1 * 7/2001 Bjelkevig ..... A46B 9/02 15/160
6,389,631 B1 * 5/2002 Keith ..... A47K 7/026 15/104.92
6,557,203 B2 * 5/2003 Meshbesher ..... A47L 23/22 15/104.92
6,668,842 B1 * 12/2003 Wilke ..... A47L 23/02 134/113
6,898,817 B1 * 5/2005 Jackson ..... B60R 3/04 15/112
7,251,850 B1 * 8/2007 Elliott ..... A47L 23/22 15/161
9,609,984 B1 * 4/2017 Kelly ..... A47K 7/04
9,661,983 B1 * 5/2017 Gonzales ..... A47L 23/263
(Continued)

FOREIGN PATENT DOCUMENTS

DE 4119986 A1 * 12/1992 ..... A47L 23/22
EP 2623014 A1 * 8/2013 ..... A47L 23/26

*Primary Examiner* — Michael D Jennings
(74) *Attorney, Agent, or Firm* — Plager Schack LLP; Mark H. Plager; Kara Verryt

(57) ABSTRACT

A device for the hands-free cleaning of dirt and debris from a bottom surface of footwear may include a platform base having a bottom surface designed to be positioned on a ground surface, and a base recess extending into a top side of the platform base; a bristle sheet designed to fit within the base recess, the bristle sheet having a plurality of bristles extending upward from a bristle sheet base; and a cavity in the interior of the platform base, the cavity sized to accommodate a volume of weighting material. The device may also include a port extending through a surface of the platform base to the cavity, such that the cavity is accessible from an exterior of the platform base. In such instances, the device may also include a plug to removably seal the port.

6 Claims, 3 Drawing Sheets

(56) References Cited

U.S. PATENT DOCUMENTS

| | | | | |
|---|---|---|---|---|
| 2002/0031639 | A1* | 3/2002 | Ullman | A47L 23/26<br>428/99 |
| 2014/0196235 | A1* | 7/2014 | Nappi, Sr. | A47L 23/26<br>15/161 |

* cited by examiner

DEVICE FOR CLEANING THE SOLES OF SHOES

BACKGROUND

The embodiments herein relate generally to cleaning devices, and more particularly, to a weighted device for cleaning the soles of shoes.

Indoor and outdoor court surfaces, as well as play fields, introduce dirt and debris to the soles of cleats and performance athletic footwear. This debris and dirt decreases the traction that these types of footwear can maintain. Loss of traction diminishes athletic performance.

Existing devices for cleaning the soles of shoes rely upon the principle of adhesion and utilize layers of sticky plastic sheets to bind dirt and debris from the soles of athletic shoes when stood upon. However, the conventional devices are costly and inefficient, as the adhesive sheets are quickly consumed by dirt and debris, rendering them non-sticky. This necessitates repeated removal of the topmost layer, bringing about the imminent expenditure of the entire stack of adhesive sheets. Moreover, these existing devices cannot be used effectively for cleated athletic footwear.

Therefore, what is needed is a device for removing dirt and debris from footwear, wherein the device is hands-free and reusable.

SUMMARY

Some embodiments of the present disclosure include a device for the hands-free cleaning of dirt and debris from a bottom surface of footwear may include a platform base having a bottom surface designed to be positioned on a ground surface, and a base recess extending into a top side of the platform base; a bristle sheet designed to fit within the base recess, the bristle sheet having a plurality of bristles extending upward from a bristle sheet base; and a cavity in the interior of the platform base, the cavity sized to accommodate a volume of weighting material. The device may also include a port extending through a surface of the platform base to the cavity, such that the cavity is accessible from the exterior of the platform base. In such instances, the device may also include a plug to removably seal the port.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to clean dirt and debris off of the bottom surface of footwear and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Base with Cavity b. Bristle Sheet

The various elements of the device of the present disclosure may be related in the following exemplary fashion. It is not intended to limit the scope or nature of the relationships between the various elements and the following examples are presented as illustrative examples only.

Figure 1:
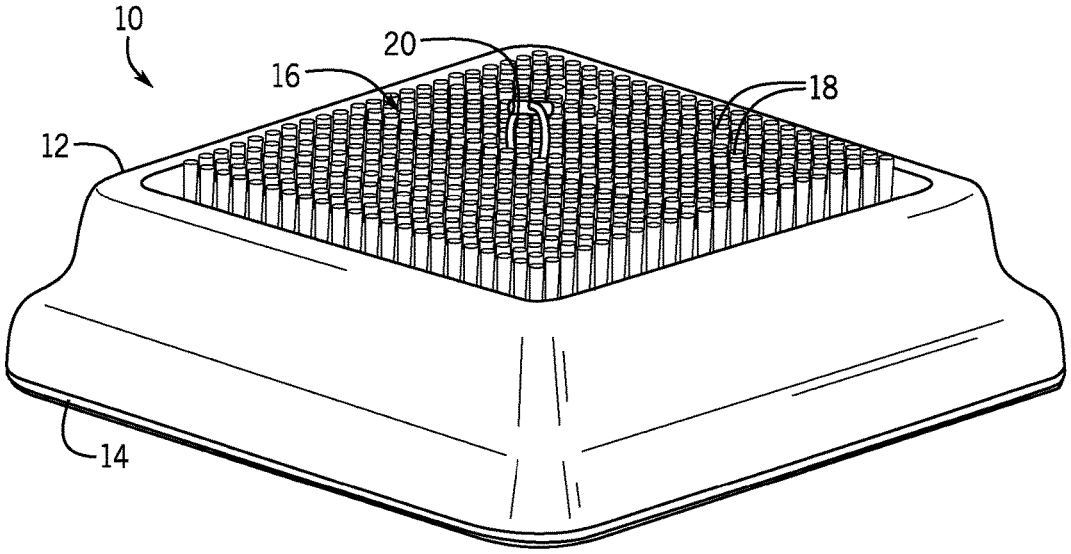
FIG. 1 is a perspective view of one embodiment of the present disclosure.
Figure 2:
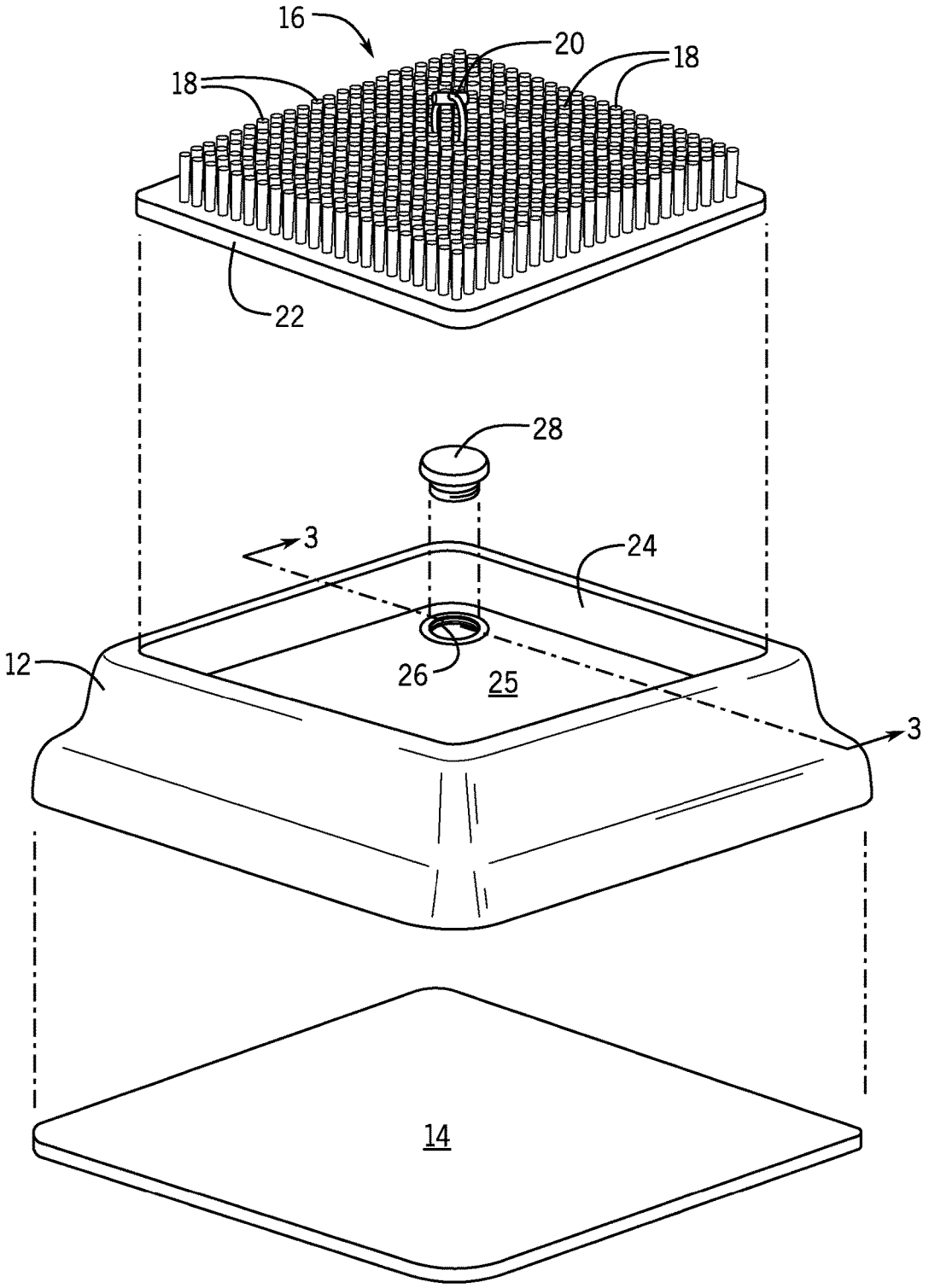
FIG. 2 is an exploded view of one embodiment of the present disclosure.
Figure 3:
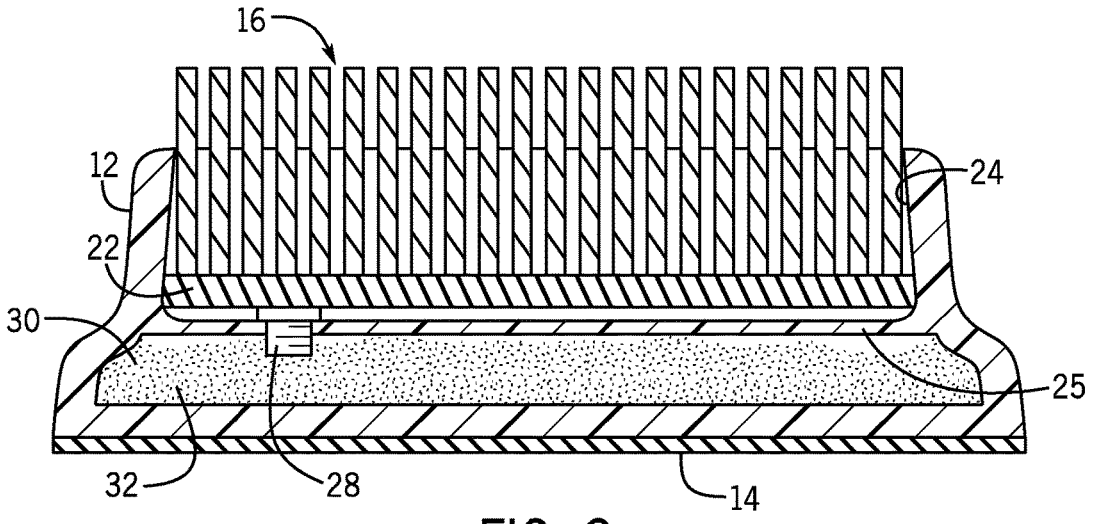
FIG. 3 is a cross-sectional view of one embodiment of the present disclosure, taken along line 3-3 in FIG. 2.

By way of example, and referring to FIGS. 1-3, some embodiments of the present disclosure include a device 10 for hands-free cleaning of dirt and debris from a bottom surface of footwear, the device 10 comprising a platform base 12 having a bottom surface designed to be positioned on a ground surface, and a base recess 24 extending into a top side of the platform base 12; a bristle sheet 16 designed to fit within the base recess 24, the bristle sheet 16 comprising a plurality of bristles 18 extending upward from a bristle sheet base 22; and a cavity 30 in the interior of the platform base 12, the cavity 30 sized to accommodate a volume of weighting material 32. The device 10 may further comprise a grip surface, such as a rubber mat 14, applied to the bottom surface of the platform base 12 to help prevent slipping or sliding of the device 10 during use. In some embodiments, the bottom surface of the grip surface may comprise a textured surface or a plurality of suction cups to further help prevent slipping or sliding of the device 10 while in use.

While not shown in the Figures, the device 10 may further comprise an anchoring frame to anchor the platform base 12 to an outdoor ground surface, such as turf, grass, or sand. This anchoring frame may comprise a plurality of stakes designed to extend downward into the ground to secure the platform base 12 to the ground.

In some embodiments, the cavity 30 may be prefilled with weighting material 32, such that the weighting material 32 is sealed within the platform base 12. In such embodiments, the bristles sheet 16 may be removably or permanently attached to a bottom wall 25 of the base recess 24.

In other embodiments, the cavity 30 may not be prefilled with weighting material 32, but rather may include a port 26, such as a threaded port, that extends through the platform base 12 such that the cavity 30 may be filled with any desired weighting material 32. The port 26 may then be closed with a plug, such as a threaded plug 28, to temporarily seal the weighting material 32 within the cavity 30. As shown in, for example, FIG. 2, the threaded port 26 may extend through the recess bottom 25. Thus, when the bristle sheet 16 is placed within the base recess 24, the plug 28 may be hidden from view. While not shown in the Figures, other embodiments include the port 26 extending through other surfaces of the platform base 12.

In embodiments where the port 26 extends through the base recess 24, the bristle sheet 16 is removable from the platform base 12 to allow for access to the plug 28 and port 26. Moreover, it may be desirable that the bristle sheet 16 is removable from the base recess 24 for cleaning purposes. Embodiments of the device 10 with the removable bristle sheet 16 may further comprise a lifting loop 20 extending upwards from the bristle sheet base 22.

As mentioned above, the bristle sheet base 22 may comprise a plurality of bristles 18 extending upward therefrom. In some embodiments, the bristle sheet base 22 may comprise repeating perforations, such as 0.5 in repeating perforations, wherein bristles 18 may be densely embedded into the bristle sheet base 22.

The device of the present disclosure may be made of any suitable or desired materials. In some embodiments, the platform base 12 and the bristle sheet base 22 comprise a polypropylene material. The bristles 18 may comprise polyethylene terephthalate. The lifting loop 20 may comprise a woven nylon strap. The weighting material 32 may comprise sand, water, synthetic weighting media, or the like.

The device of the present disclosure may have any desired size. In a particular embodiment, the bristle sheet base 22 may have a size of 14.6 inches long, 20.6 inches wide, and 1 inch tall. The bristles 18 may be able 3 inches long. However, the bristles 18 may comprise a 6 inch long PET material that are doubled over and set within the perforations in the bristle sheet base 22 by a central staple and driver, creating the 3 inch bristles. However, other manufacturing methods from the bristles sheet 16 are certainly envisioned. The lifting loop 20 may be about 0.75 inches wide by about 6 inches long. The platform base 12 may be about 18 inches long, about 24 inches wide, and about 4 inches tall. The base recess 24 may have a size of about 15 inches long, about 21 inches wide, and about 1 inch deep. The cavity 30 may have a size of, for example, about 15 inches long, about 21 inches wide, and about 2 inches tall. In any case, the cavity 30 may be designed to accommodate about 20 to 30 pounds of weighting material 32.

To use the device of the present disclosure, the user may fill the cavity 30 with weighting material 32 and place the platform base 12 on a ground surface. The bristles sheet 16 may be placed within the base recess 24. The user may then raise his or her footwear above the bristle brush unit and swipe the soles or cleats through the bristles, resulting in complete or nearly complete removal of dirty, mud, or other debris from the sole surface. The device 10 may be cleaned by removing the bristles sheet 16 from the base recess 24 and rinsing it down with water.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A device for hands-free cleaning of dirt and debris from a bottom surface of footwear, the device comprising:

a platform base having a bottom surface designed to be positioned on a ground surface, and a base recess extending into a top side of the platform base;

a bristle sheet designed to fit within the base recess, the bristle sheet comprising a plurality of bristles extending upward from a bristle sheet base;

a cavity in the interior of the platform base, the cavity sized to accommodate a volume of weighting material; and a lift loop extending upward from the bristle sheet base, the lift loop being designed to provide for removal of the bristle sheet base from the platform base.

2. The device of claim 1, further comprising:

a port extending through a surface of the platform base to the cavity; and a plug designed to engage with the port to removably close the port.

3. The device of claim 1, further comprising a grip material applied to the bottom surface of the platform base.

4. The device of claim 3, wherein the grip material comprises a rubber mat with a textured bottom surface.

5. The device of claim 1, wherein the bristles comprise polyethylene terephthalate.

6. The device of claim 1, further comprising weighting material positioned within the cavity, the weighting material being a member selected from the group consisting of water, sand, and a synthetic weighting material.

* * * * *